US007274306B2

(12) United States Patent
Publicover

(10) Patent No.: US 7,274,306 B2
(45) Date of Patent: Sep. 25, 2007

(54) TRAFFIC MANAGEMENT DEVICE AND SYSTEM

(76) Inventor: Mark W. Publicover, 18505 Marshall La., Saratoga, CA (US) 95070

( * ) Notice: Subject to any disclaimer, the term of this patent is extended or adjusted under 35 U.S.C. 154(b) by 95 days.

(21) Appl. No.: 11/015,592

(22) Filed: Dec. 16, 2004

(65) Prior Publication Data

US 2005/0140523 A1 Jun. 30, 2005

Related U.S. Application Data

(60) Provisional application No. 60/532,484, filed on Dec. 24, 2003.

(51) Int. Cl.
*G08G 1/00* (2006.01)

(52) U.S. Cl. ..... 340/907; 340/909; 340/916; 340/918; 340/919; 701/117; 701/119

(58) Field of Classification Search ..... 340/901, 340/909, 906, 902, 916, 918, 919, 923, 929, 340/988, 907; 701/1, 117, 200, 201, 300, 701/118, 119
See application file for complete search history.

(56) References Cited

U.S. PATENT DOCUMENTS 6,463,900 B1 * 10/2002 Wakabayashi et al. ... 123/179.4
6,516,273 B1 * 2/2003 Pierowicz et al. ..... 701/301
6,535,142 B2 * 3/2003 Wakabayashi et al. ..... 340/929
6,807,464 B2 * 10/2004 Yu et al. ..... 701/1
6,989,766 B2 * 1/2006 Mese et al. ..... 340/907

* cited by examiner

*Primary Examiner*—Davetta W. Goins
(74) *Attorney, Agent, or Firm*—Edward S. Sherman

(57) ABSTRACT

A smart traffic control device transmits information to approaching vehicles regarding its current and future state enabling vehicles to control their speed to avoid arriving at the traffic control device until it permits the passage of traffic, thus avoiding stopping, idling and reaccelerating when reaching the traffic control device. In other embodiments the traffic control device or systems receives information from vehicles, transmitting it to other vehicles.

5 Claims, 2 Drawing Sheets

TRAFFIC MANAGEMENT DEVICE AND SYSTEM

CROSS REFERENCE TO RELATED APPLICATIONS

The present application claims priority to the U.S. provisional application having Ser. No. 60/532,484 entitled "Traffic Management Device and System" filed on Dec. 24, 2003, which is incorporated herein by reference.

BACKGROUND OF INVENTION

The present invention relates generally to the field of transportation, and more specifically to a process for improving the traffic flow on roads that utilize lights and signage to control the flow of vehicles through intersections.

While traffic lights work effectively to allow for the safe passage of vehicles through intersections, they have limited capabilities to manage traffic flow in their current configuration. Some traffic lights operate in response to detecting the relative traffic volume in the cross streets they regulate, providing a greater interval of time for vehicles to pass in proportion to the higher traffic load in one direction, with a shorter travel interval to the opposing traffic. However, even when traffic lights are optimally efficient to manage a difference in traffic flow on second by second needs basis, vehicles are necessarily stopped in lines at the traffic light for some period of time, creating traffic congestion.

Increasing population density has generated growing traffic congestion problems that increase air pollution and fuel inefficiency.

It is therefore the primary object of the invention is to reduce traffic congestion.

Accordingly, the inability to better coordinate individual vehicle speeds on roads with intersections is a major cause of traffic congestion, air pollution, and fuel inefficiency.

Another object of the invention is to provide for more fuel-efficient transportation on roads utilizing traffic lights and signage at intersections.

Another object of the invention is to provide for more fuel-efficient transportation on freeways and roads without intersections, especially during periods of heavy traffic.

Another object of the invention is to increase transportation system capacity with minimum capital cost and taking of land for infrastructure.

A further object is to improve safety by more effectively regulating and coordinating the flow of traffic through intersections and on freeways.

Other objects and advantages of the present invention will become apparent from the following descriptions, taken in connection with the accompanying drawings, wherein, by way of illustration and example, an embodiment of the present invention is disclosed.

SUMMARY OF INVENTION

In the present invention, the first object is achieved in accordance with a preferred embodiment of the invention, there is disclosed a process for managing traffic on roads with and without intersections by enabling drivers and vehicle control systems to more effectively manage the speed of their vehicles to improve fuel efficiency and better coordinate traffic flow.

In one aspect of the invention, each vehicle is fitted with a device that times approaching traffic lights and relays information to the driver via a display that enables the driver to adjust the speed of the vehicle so that it reaches the intersection while the light is green. This knowledge helps the driver to manage vehicle speed so that he does not waste the time and energy to stop and wait for the light to change.

A secondary benefit of the invention is to help coordinate the speed of vehicles on freeways to maintain higher speeds during heavy traffic periods Other benefits of the invention is realized with the creation of new traffic laws to more effectively manage driver behavior so as to increase the benefits of the invention and the technology surrounding the invention.

The above and other objects, effects, features, and advantages of the present invention will become more apparent from the following description of the embodiments thereof taken in conjunction with the accompanying drawings.

DETAILED DESCRIPTION

A conventional traffic control device (TCD) such as alternating color lights, i.e. green (go), yellow (warning), red (stop), flashing lights or variable signage, and the like is optionally controlled by a master controller, timing circuit, a pedestrian cross-walk or emergency vehicles. Such TCD may also deploy variable timing cycles, that is the percentage or length of time one cross street receives a green light differs from the other cross street, in response to measured traffic volume or historical patterns. All these embodiments of TCD's are compatible with the instant invention, characterized by a TCD that deploys a transmitting device to signal approaching traffic of its current state and the time remaining until the state changes, or optionally until it returns to the "green" state for on coming traffic. Accordingly, in another aspect of the invention the vehicle has a receiving device to collect signals from the TCD, the receiving device being operative to ascertain the vehicles position with respect to the TCD and determine a preferred rate of speed so as to arrive at the TCD while it is in the "green" state, thus avoiding the deceleration, waiting at the CD and acceleration to driving speed.

The TCD can transmit the requisite information from its location using a broad or narrow beam of RF or microwave transmission, optical transmission or a series of more localized transmitters dispersed about the roadway.

The vehicle can determine it's current position through GPS, detection of embedded sensors in the roadway, Doppler radar and like methods to measure the actual distance from the TCD can be determined by the combined information received from the TCD transmission and other sources.

Figure 1:
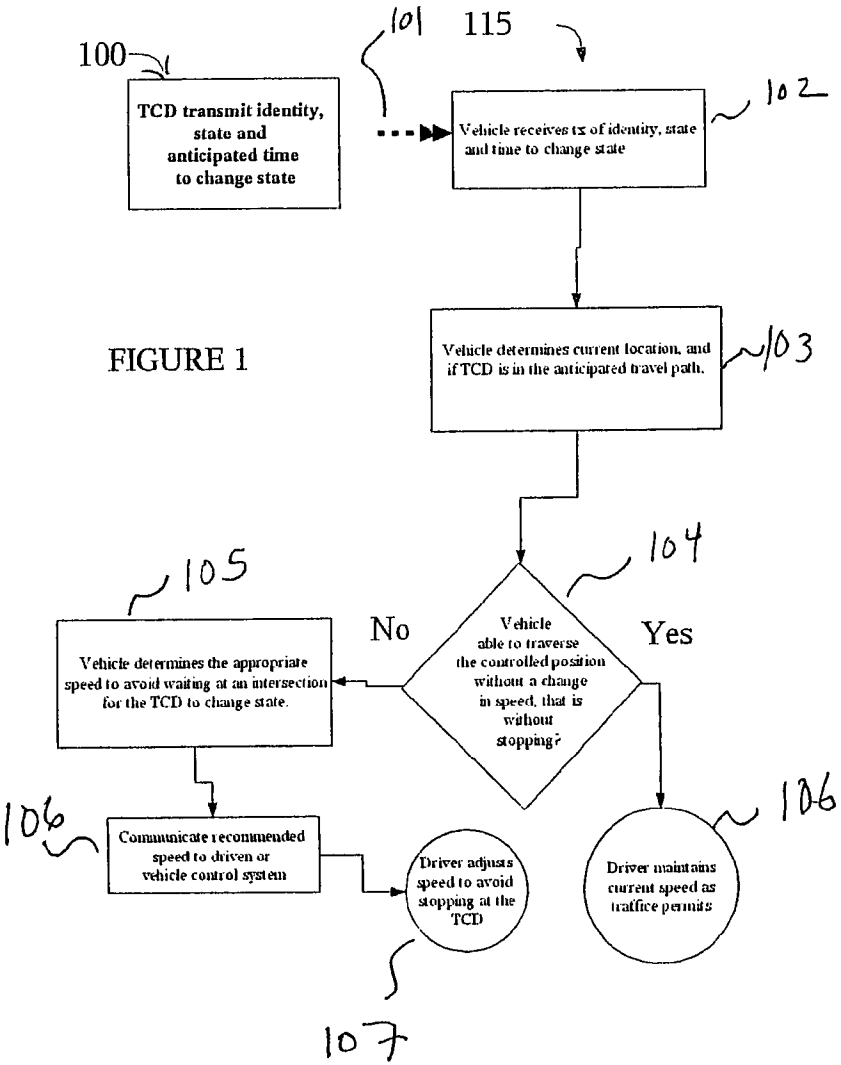
FIG. 1 is a flow chart illustrating the operative principle operative in the first embodiment of the invention.
Figure 2:
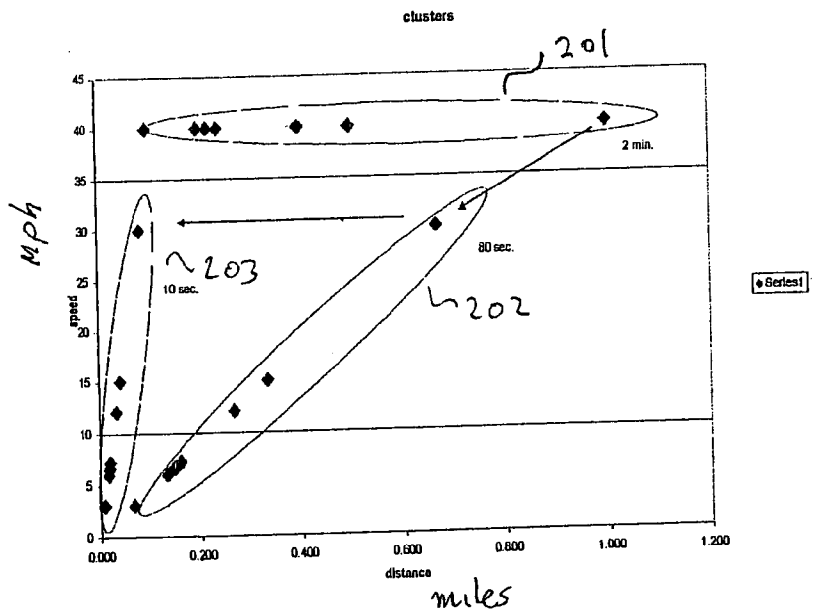
FIG. 2 is a plot showing the speed and position of a cluster of vehicle subject to the control systems and devices described with respect to FIG. 1

FIG. 2 is plan view of an intersection illustrating one embodiment for communicating with a plurality of vehicles according to FIGS. 1 and 2. As vehicles approach the intersection from four directions, the TCD broadcasts a signal to four sets of approaching vehicles. In this embodiment the broadcast patterns is narrow and corresponds substantially with the width of the roadway to avoid signal overlap and confusion with adjacent TCDs that also broadcast signals.

Figure 4:
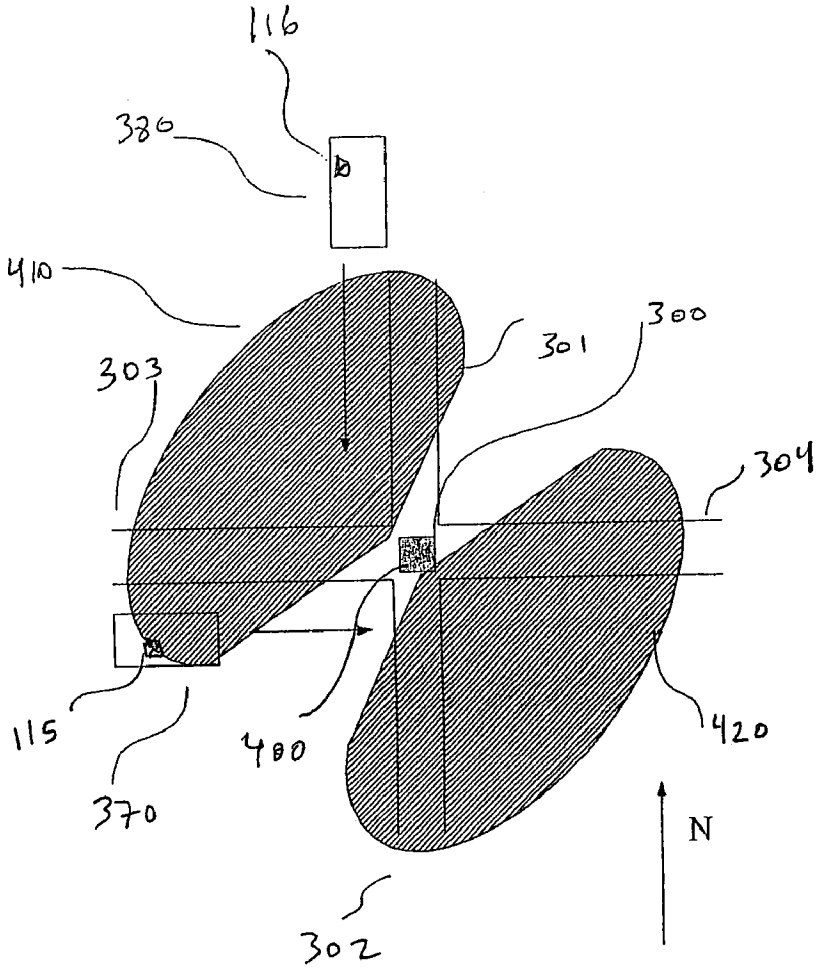
FIG. 4 is plan view of an intersection illustrating another embodiment for communicating with a plurality of vehicles according to FIGS. 1 and 2
Figure 3:
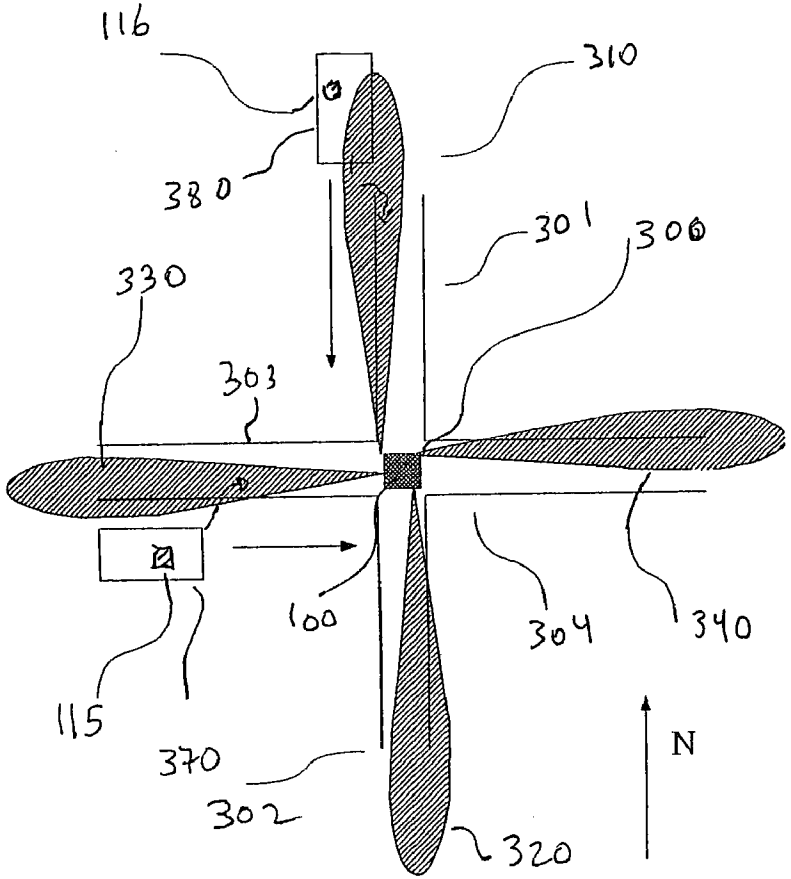
FIG. 3 is plan view of an intersection illustrating one embodiment for communicating with a plurality of vehicles according to FIGS. 1 and 2.

In accordance with the present invention, a traffic control device (TCD) 100 is operative to transmit or broadcast signal to approaching vehicles, wherein the approaching vehicles uses the information received as set forth in the flow chart in FIG. 1. Thus, the composite signal received by approaching vehicles in step reflects the state and timing of the control device, and depending on the transmission or broadcast scheme deployed, examples of which are illustrated in FIGS. 3 and 4, the location and identity of the TCD, and other information necessary for vehicles approaching from a specific direction to distinguish the appropriate signal from that of signals meant for vehicles approaching from a different direction.

Vehicles are in turn equipped with a device 115, for vehicle 170 (and 116 for vehicle 180) to receive the composite signal and determine an appropriate speed that would permit them to safely reach and traverse the controlled intersection without the need to stop at the intersection when the control device permits cross traffic through the intersection. Thus, vehicles would avoid waiting in line at intersections, idling that wastes fuel and increases pollution. Further, as traffic flow would not be retarded by the time consumed when each vehicle in a line accelerates from a stopped position, the overall traffic capacity of roads would be reduced vehicles that need when the control devices that is received by approaching Thus, in step 101 in FIG. 1 the TCD transmits it's identity, state and anticipated time to change state Device 115 is embedded or associated with the vehicle, in step 102 receives the transmission of the TCD identity, state and time to change state.

In step 103 the vehicle determines its current location with respect to the TCD, and if TCD is in anticipated travel path In step 104 Device 115 is operative to determine if the vehicle will be able to traverse the controlled position without a change in speed, thus avoiding having to stop.

In the event that step 104 determines that the vehicle cannot traverse the intersection without reducing speed (NO branch to step 104), in the next step 105 device 115 determines the appropriate speed to avoid waiting at an intersection for the TCD to change state.

In step 106, which follows step 105, device 115 communicates a recommended speed to the vehicles driver, or alternatively automatically lowers the speed or a cruise control maximum speed threshold for the vehicle. In the former case, the driver adjusts the speed of the vehicle, step 107, to avoid waiting at the intersection.

In the event that step 104 determines that the vehicle can traverse the intersection without reducing speed (Yes branch to step 104), in the next step 106 the driver maintains the current speed until device 115 instructs or otherwise controls the vehicle in response to a signal received from TCD 100.

FIG. 2 and the corresponding Table 1 illustrate the operative principles with a cluster of cars identified as A-F all approaching an intersection. In Table 1 the vehicles approach at constant speed (column 2), being at varying distances from the intersection (column 1). As a first approximation to implementing the invention, we now calculate an ideal speed to avoid stopping at the intersection, based on a change from red to green in 2 minutes. It is a simple matter to compute the maximum speed below the speed limit by dividing the distance to the intersection by the time remaining until the TCD turns green.

FIG. 2 illustrates the results of the computations in a graphic format wherein the speed of each vehicle is plotted on the ordinate as a function of distance from the intersection, with the speed plotted on the abscissa. The plots are made for 3 time interval, the first interval, marked by region 201, being at 2 minutes before the light will turn from red (the current state) to green, when all vehicles are traveling at the speed limit (40 mph). The other two sets of points highlighted within the border of regions 202 and 203 respectively represent the position and speed of the same vehicles 80 and 10 seconds prior to the light changing. The vehicles closer to the intersection during the red condition will be slowed more than vehicles more distant. Thus, as time elapses the vehicles tend to cluster into groups. It should be appreciated that while the TCD is green, the group of vehicles that can safely traverse the intersection will be instructed to travel at a certain speed, subject to traffic conditions, and thus may be allowed to accelerate up to or even beyond the speed limit to optimize the spacing and speed of the group relative to other groups fore and aft.

FIG. 3 is a plan view of an intersection of two roads at intersection 300. The road carrying north-south traffic has a first segment 301 in which vehicle 380 is traveling southbound as it approaches intersection 100, whereas segment 302 carries northbound traffic. The road carrying east-west traffic has a first segment 303 in which vehicle 370 approaches intersection 300 from the west, whereas segment 304 carries traffic that approaches intersection 200 from the east. In this example, TCD broadcasts a separate directed signal to approaching traffic, that is broadcast signal 330 for vehicles approaching on segment 303, signal 340 for vehicles approaching on segment 304, signal 310 for vehicles approaching on segment 310 and signal 320 for vehicles approaching on segment 302. Thus, vehicle 370 on segment 303 is intended to be responsive to the information in broadcast signal 330, as received, analyzed and communicated by device 115 there within. Whereas vehicle 380 on segment 301 is intended to be responsive to the information in broadcast signal 310, as received, analyzed and communicated by device 116 there within. Naturally, there could be one transmission signal for each intersection or road with multiple intersections or an area wide signal that carries all the necessary data. This data could then be analyzed by each vehicle's reception device so that only pertinent information is displayed to the driver.

FIG. 4 is plan view of intersection 300 illustrating another embodiment wherein TCD 400 utilizes fewer, but broader signal broadcasts, signal 410 covering vehicles on segments 301 and 303, while signal 420 covers vehicles in segments 302 and 304. This embodiment differs from that illustrated in FIG. 3 in that the broadcast pattern is broad, and not limited to a particular section of roadway, as the devices provides a code multiplexed signal that includes information pertinent to vehicles approaching from 2 or more directions wherein the vehicles select the appropriate code relevant to their direction of travel or approach to the intersection. This is particularly beneficial if the vehicles driver is being prompted to follow a course set out in a GPS enabled navigation system, as the computation system can be programmed to identify TCD's that correspond to the planned travel route, and to the extent it can intercept multiple TCD signals within the route, assist the vehicle driver to maintain a speed that optimally permits the traverse of multiple controlled intersections with the minimum acceleration and deceleration.

In alternative embodiments, a vehicle speed controller is operatively responsive to device 115, for example a cruise control system and may take into account acceleration characteristics of the vehicle.

In another aspect of the invention driver displays/guides and vehicle control systems are used to control the length of time for green, yellow, and red lights, the spacing between vehicles and groups of vehicles (pods), and the size of pods. This traffic flow system can also include a method for placing vehicles in pods so that vehicles can be coordinated to travel in pods to increase the efficiency of traffic flow. The spacing between pods permits the addition of new vehicles to the pod in a controlled sequence. The pods and the crossing lights are then coordinated to maintain vehicle/pod speeds so that intersections can be crossed without the need to stop.

In yet another aspect of the invention the vehicle includes onboard speed/brake controlling systems that synchronize vehicle speed with intersection crossing so that the driver is not required to manually control the vehicle's speed.

In yet another aspect of the invention, vehicles entering a road are required to stop and wait for a pod to approach and then are directed, manually or automatically, to take a position in a given lane at the front or rear of the pod.

Vehicles waiting for a pod can park on both sides of a lane(s) for travel in one direction. The number of vehicles allowed to joint a given pod can be controlled to maximize the flow of traffic.

In yet another aspect of the invention vehicles awaiting a light change at an intersection are required to wait a distance away from the intersection so that they can begin to accelerate prior to the light changing in order to maximize the number of cars that can pass through the intersection during the computer-controlled period. The period is controlled by the number of vehicles waiting to pass through the intersection and the priority given to the traffic demands on that road versus the traffic demands on the intersecting or cross road.

In yet another aspect of the invention stop/yield signs (or any sign) can be fitted with a transmitter/receiver device and indicator lights that signal an approaching vehicle if another vehicle is approaching the intersection via another road. The signal would be actuated by an approaching vehicle's transmission of data as to speed, time to crossing, intended travel path, and it would take into account other vehicles approaching the intersection from another road or direction of travel. The integrated stop sign/signal could be controlled by on board vehicle computers that synchronize with other vehicle computers approaching the intersection or by a simple computer integrated in the sign/signal. Once again, vehicle speed could then be controlled so the approaching vehicles would cross the intersection at different times.

In yet another aspect of the invention, the signals could also be used to enforce speed limits on different roads. For instance, on a residential street an integrated stop/yield signal would only signal a stop for vehicles exceeding the speed limit by a given percentage, whereas vehicles obeying the speed limit would be given priority and allowed to roll through the intersection rather than being required to stop. Less air pollution would be generated by allowing vehicles to roll through stop sign intersections in residential areas. The onboard vehicle systems could be turned off or on by the driver.

In yet another aspect of the invention, vehicles use mapping programs to communicate with the central traffic system the intended travel path for maximizing the flow of traffic. For instance, a certain vehicle's travel path may lead to a congested area several miles ahead and a faster, secondary path could be recommended. Also, if the secondary path is not chosen then the vehicles progress may be slowed or even pulled to the right lane and slowed or pulled off the road and stopped, thus allowing vehicles with faster or less congested travel paths to receive a higher priority than the vehicle traveling toward a congested area.

In yet another aspect of the invention, emergency vehicles would be given total or partial over-ride priority at intersections and on roadways. Partial over-ride priority could involve timing changes to lights/signals that might slightly slow the progress of the emergency vehicle so that its travel is safer and less disruptive to traffic flow. In addition, travel path data indicating congested roads and faster travel paths could be used to improve destination arrival times.

In yet another aspect of the invention, freeway traffic can be more safely managed by transmitting to vehicles speed changes to help prevent major slow downs or stops by better managing vehicles speeds as they approach congested traffic zones. Radio/laser (or the like) receiver/sender devices could be used to keep track of all vehicle speeds and/or intended travel paths throughout an entire freeway system. This information could then be used to inform drivers as to optimum speeds, lane of travel, and travel plans/paths. For instance, accident information could also indicate which lanes are blocked or have non-moving vehicles a mile ahead and could inform drivers when to change lanes and the approach speed. Vehicles that are in close proximity to each other could also exchange data between them to coordinate lane changes with each other, prioritize queue placement, and speed of travel.

In yet another aspect of the invention, the communication between the vehicle and the signal light at an intersection could be used to prevent collisions from crossing traffic. For instance, a disabled vehicle may be unable to stop causing it to run a red light. A vehicle that continues to move toward the intersection would be detected by the control system that would then prevent the intersection signal from turning to red or if the signal had already switched then all intersection signals could immediately switch to red and begin flashing. An alarm could also be sounded at the intersection and inside all vehicles traveling toward the intersection.

In yet another aspect of the invention vehicles fitted with an onboard system(s) that would function as described above could be used to guide the speed of vehicles that are not fitted with a system. For instance, a special indicator light could be used by the fitted vehicle to inform an unfitted vehicle of the optimum travel speed, etc.

In yet another aspect of the invention vehicles that do not utilize this technology or that are awaiting a light change are required to travel or wait in a designated lane to allow other lanes free for vehicles using the technology or vehicles traveling at a speed toward the intersection for the light to change.

While the invention has been described in connection with a preferred embodiment, it is not intended to limit the scope of the invention to the particular form set forth, but on the contrary, it is intended to cover such alternatives, modifications, and equivalents as may be within the spirit and scope of the invention as defined by the appended claims.

The invention claimed is:

1. A traffic management method, the method comprising the steps of a) providing at least one traffic control device having;

i) means to determine the location and speed of a plurality of approaching vehicles, ii) means to transmit at least a recommended speed to at least a portion of the plurality of approaching vehicles, b) providing a plurality of vehicles having;

i) means to communicate with the traffic control device, ii) wherein said at least one traffic control device and at least a portion of said plurality of vehicles has a means to calculate means to determine the future position of the vehicles as they approach the traffic control device based on their speed, c) directing a first subset of the plurality of vehicles to increase speed, d) directing a second subset of the vehicles to decrease speed, e) whereby the fist and second subsets of vehicles are separated into spaced apart first and second pods of vehicles for which at least a portion of the vehicles in each pod accelerate or decelerate to approach a common speed in each pod.

2. The method of claim 1 further comprising the step of adjusting the time of the traffic control device wherein each of the first and second pods can pass through the intersection at their respective speeds without a significant change in speed or speed range associated with each pod.

3. The method according to claim 1 wherein the vehicles in the first and second subsets are approaching the traffic control device on the same road.

4. The method according to claim 2 wherein the traffic control device halts traffic between the first subset and the second subset.

5. The method according to claim 4 wherein the traffic control device halts traffic traveling in the same direction as the first and second pods.

* * * * *